US006193092B1

(12) United States Patent
Witter

(10) Patent No.: US 6,193,092 B1
(45) Date of Patent: Feb. 27, 2001

(54) HIGHLY RESILIENT, NON-STRUCTURAL FLOATING ROOF FOR TANKS FOR STORING LIQUIDS

(75) Inventor: Roger Vieira Witter, deceased, late of Sao Leopoldo (BR), by Mario Luiz Novaaes Avila, legal representative

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 09/078,757

(22) Filed: May 15, 1998

(30) Foreign Application Priority Data

May 15, 1997 (BR) ..... 9704844

(51) Int. Cl.[7] ..... B65D 88/36

(52) U.S. Cl. ..... 220/218; 220/222

(58) Field of Search ..... 220/216, 218, 220/222

(56) References Cited

U.S. PATENT DOCUMENTS

| | | | | |
|---|---|---|---|---|
| 1,698,158 | | 1/1929 | Glass . | |
| 1,819,401 | | 8/1931 | Bailey . | |
| 3,462,040 | * | 8/1969 | Galloway | 220/218 |
| 3,690,502 | | 9/1972 | Guber . | |
| 3,944,113 | | 3/1976 | Heisterberg . | |
| 3,972,444 | | 8/1976 | Adams . | |
| 4,036,394 | | 7/1977 | Bodley . | |
| 4,202,460 | * | 5/1980 | Imbeault | 220/218 |
| 4,213,280 | * | 7/1980 | Sandborn | 220/218 X |
| 5,074,427 | * | 12/1991 | Siemerink et al. | 220/218 |
| 5,212,090 | * | 5/1993 | Landine et al. | 220/218 X |

* cited by examiner

*Primary Examiner*—Stephen K. Cronin
(74) *Attorney, Agent, or Firm*—Nixon & Vanderhye PC

(57) ABSTRACT

The present invention relates to a floating roof (1) with non-structural characteristics, which basically comprises a peripheral ring (7) formed by the joining of a plurality of plates and which has a plurality of floats (2), and a central platform (8) formed by the joining of a plurality of floats (2), and a central platform (8) formed by the joining of a plurality of plates and which has floats (2).

14 Claims, 3 Drawing Sheets

HIGHLY RESILIENT, NON-STRUCTURAL FLOATING ROOF FOR TANKS FOR STORING LIQUIDS

FIELD OF THE INVENTION

The present invention relates to a floating roof for use in tanks for storing liquids, such as petroleum and its derivatives.

PRIOR ART

Storage tanks are widely used in the petroleum industry and are essential to the functioning of an operational unit. They may be intended, for example, for storing crude oil, intermediate products and final products.

Given the highly volatile nature of these products, use is made, in the storage tanks, of a roof capable of floating over the liquid stored as a way of preventing the undesirable accumulation of gases between the layer of liquid and the roof.

Various types of floating roof are known. One type that is widely used is the pontoon-type floating roof, which, on the periphery, has a toroidal structure which is responsible for guaranteeing the roofs buoyancy. The remaining area of the roof is closed with metal plates which are in contact with the liquid. This type of roof has the disadvantage that it is relatively unstable and may, for example, overturn relatively easily if rainwater is concentrated in one area of its upper part.

Another type of floating roof, known by specialists as a "buoy roof", is fairly similar to the pontoon-type floating roof. The major difference relates to the use of floats fixed above the metal plates, which substantially improves the roof's buoyancy in the event of the plates or weld beads rupturing. However, unfavourable weather conditions, such as high winds and a significant accumulation of rainwater, may cause the roof to sink. Another problem to be considered is the possibility of an accumulation of gas in the submerged area of the pontoon, which, in addition to creating the right conditions for corrosion, may also promote sinking of the roof when this area is subjected to the load constituted by rainwater, for example.

Another widely used floating roof is the double floating roof, in which one of its faces is in direct contact with the liquid and the other face remains at a certain height above this, supported by a structure. This type of construction has the advantages of being highly buoyant and of the upper part of the roof being practically smooth, which, in the event of high winds, prevents the occurrence of loads which could cause the roof to sink. It does have certain disadvantages such as, for example, the fact that it is extremely heavy and expensive.

A further disadvantage of double floating roofs relates to the reduction in the tank's useful storage volume which may, in certain cases, be significant. This reduction is due to the fact that the floating roof requires a large volume in order to create sufficient upward thrust to enable it to float.

All models of floating roofs known hitherto have one characteristic in common which is that they have a structural component, which makes the roof retain its shape; in the case of pontoon-type roofs or buoy roofs, the structural component is the peripheral pontoon, and, in the case of double roofs, the structural component is the roof itself.

This common characteristic gives rise to a number of disadvantages such as, for example, excessive weight. However, the greatest disadvantage relates to the difficulty these roofs have in withstanding unbalanced loads, such as those caused by access ladders or, alternatively, by a concentration of rainwater arising from deficiencies in the drainage system. Situations may arise in which this unbalanced load causes the floating roof to sink, which would be a disastrous event.

The present invention proposes the use of a roof which has no structural component imparting overall rigidity to the roof, thereby enabling the roof to cope with situations of unbalanced load without a problem.

SUMMARY OF THE INVENTION

The present invention relates to a type of floating roof with non-structural characteristics, as defined in claim 1.

The number of floats to be used and their dimensions are characteristics which depend on the dimensions of the floating roof and also on the characteristics of the plates which will be used to construct the floats and the floating roof.

To facilitate the installation of a seal to seal the space between the periphery of the floating roof and the side of the storage tank on which it is installed, use is made of a support ring fixed to the periphery of the floating roof.

BRIEF DESCRIPTION OF THE DRAWINGS

The characteristics of the present invention will be better understood on the basis of the detailed description which will be given hereinbelow, purely by way of example, of a preferred embodiment, in combination with the drawings mentioned below, which are an integral part of the present specification.

DESCRIPTION OF A PREFERRED EMBODIMENT

As may be seen in the description of the prior art, the major problem presented by currently used floating roofs is the risk of their sinking when subjected to an uneven load. This situation arises because all known floating roofs are in fact rigid structures with little ability to counterbalance any uneven load.

The objective of the present invention is to provide a non-structural floating roof capable of remaining buoyant under the most adverse conditions possible, as will be seen below.

Figure 1:
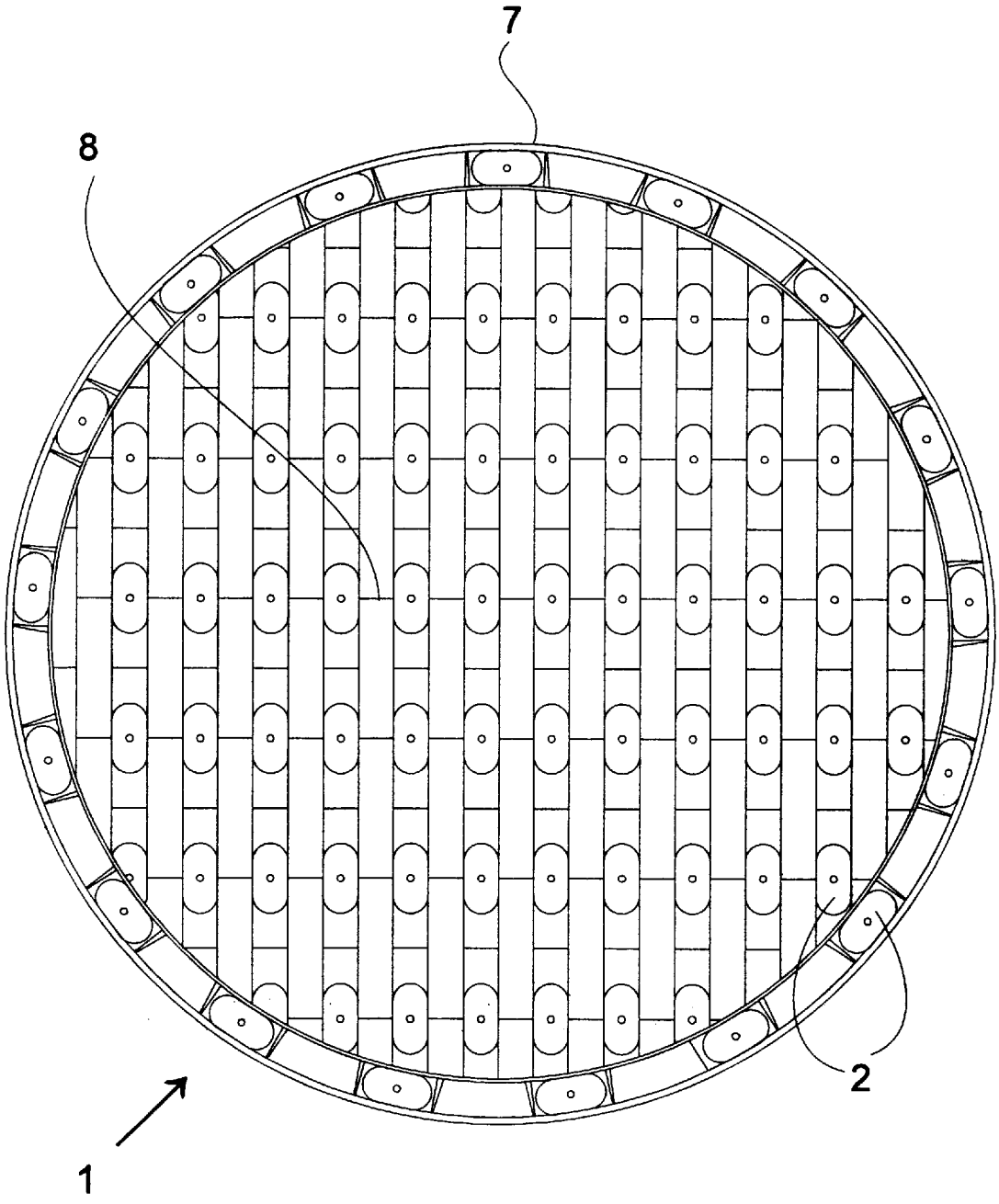
FIG. 1 is a top view of one embodiment of a floating roof of the present invention.

FIG. 1 shows an embodiment of a floating roof (1) constructed in accordance with the technical precepts of the invention now described and it is formed basically by the joining of a plurality of plates which form a central platform (8). There is also a peripheral ring (7), likewise formed by the joining of a plurality of plates. The outermost plates of the central platform (8) are trimmed so as to allow a perfect join between it and the plates forming the peripheral ring (7). The plates used are generally laminated layers of metal which are typically 3.5×1.5 m in size. The plates are advantageously thin and are preferably joined by means of an overlapping welded joint. That is, the plates are desirably overlapped and then welded together by a very thin weld to ensure that the roof does not have overall rigidity.

In order to make the floating roof (1) buoyant, use is made of floats (2) whose installation complies with the following criteria:

the peripheral ring (7) must have a high degree of buoyancy and, for that purpose, must have a plurality of floats distributed preferably symmetrically. In the present embodiment, smooth plates and plates with floats (2) fitted on their upper face are alternated;

floats (2) must be installed on the central platform (8) so as to give the latter sufficient buoyancy not only to support its own weight but also to withstand any loads resulting from rainwater, high winds, etc. The distribution of the floats (2) over the central platform (8) has to try to be as symmetrical as possible so as to make the central platform (8) uniformly buoyant.

The precise number of floats to be used, as well as their dimensions, are characteristics which depend on the dimensions of the floating roof (1) and also on the characteristics of the plates which will be used to construct the floating roof (1) and the floats (2). In fact, these are design variables which depend on a number of factors such as, for example, the availability of material or, alternatively, the use of plates with standardized dimensions, with a view to reducing costs, amongst other things.

In the present embodiment it is proposed to install floats (2) on each of the plates of alternate rows of the platform (8) and also on alternate plates of the peripheral ring (7), as may be seen in FIG. 1. However, this is only one of the many possibilities for installing the floats.

Figure 2:
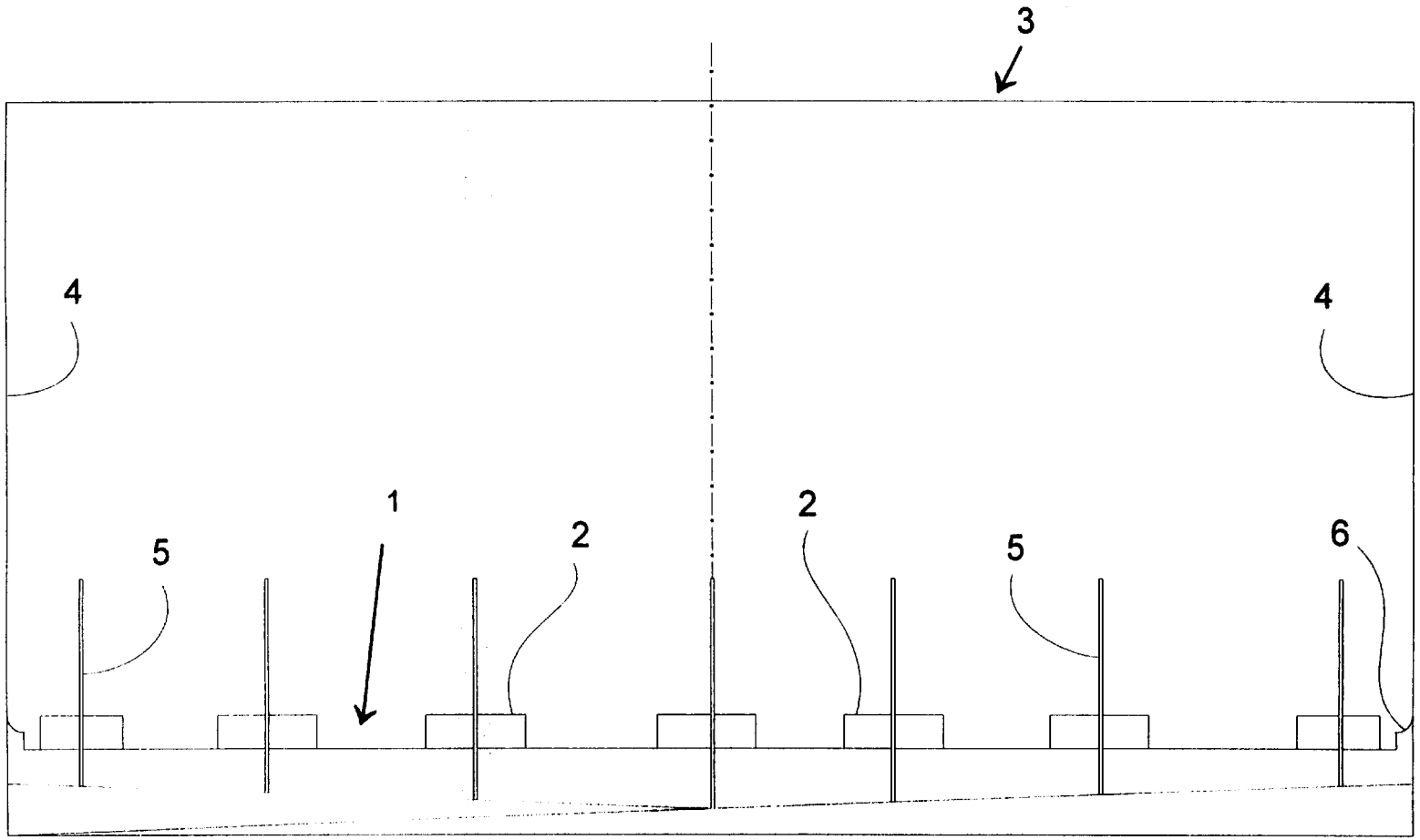
FIG. 2 is a side view in section of the floating roof shown in the previous Figure.

FIG. 2 is a side view in section of the floating roof (1) shown in FIG. 1, which has been installed in a storage tank (3). There are support legs (5), which, in the present embodiment, pass through the floats (2). There is also a seal (6) installed on the peripheral ring (7). This seal (6) is intended for sealing the annular space between the floating roof (1) and the side (4) of the storage tank (3). It should be pointed out that the seal (6) and the support legs (5) are components which are well-known to specialists and do not form part of the scope of the present invention, being mentioned purely for the purposes of the description.

Figure 3:
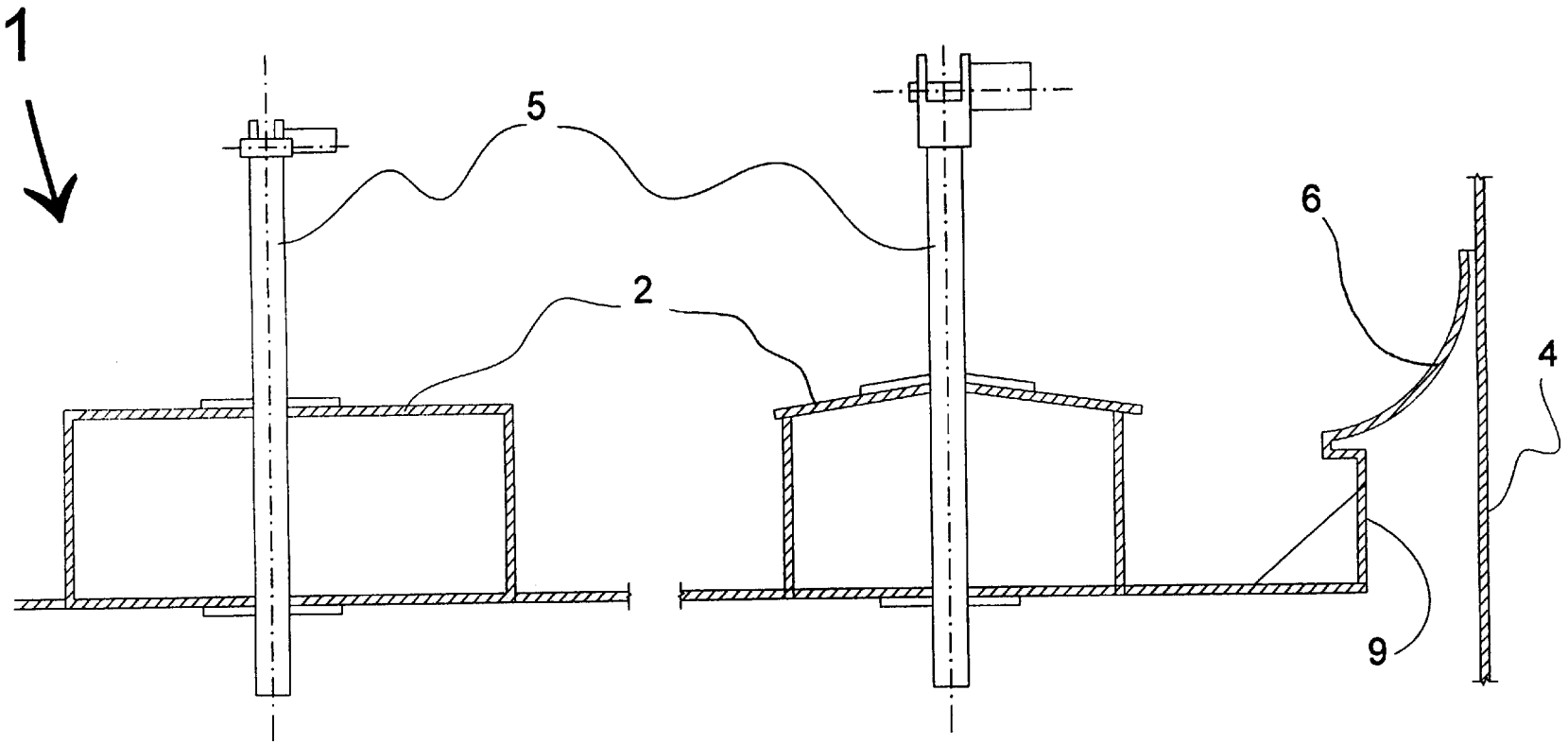
FIG. 3 is a side view in section of the floating roof shown in the previous Figures, showing details of the floats.

FIG. 3 shows a side view in section of the floating roof shown in the previous Figures. The cover of the floats (2) is domed, with a view to preventing a concentration of rainwater thereon, which could give rise to corrosion.

As the periphery of the floating roof (1) is thin, use is made of a support ring (9) to facilitate installation of the seal (6). It should be pointed out that other means may be used to fulfil this function, but the support ring (9) described above was selected for the present embodiment as it is regarded as the best technical solution.

Purely for the purposes of simplification, it has been decided that the Figures should not show some of the other components which are necessary for the proper operation of a floating roof, such as vacuum-relief valves, the rainwater drainage system and access ladders, for example.

The floating roof which is the subject of the present invention has the significant advantage of not having any structural component. This characteristic means it is able to deform elastically when subjected to uneven loads and to return to its original position as soon as the load is removed, and the deformation is only in the area close to the load and does not spread to the rest of the floating roof. In other words, the further away a specific area of the floating roof is from the area under load, the lesser will be the extent of elastic deformation suffered by that area, and it may be that no deformation occurs at all. It behaves in a similar manner to the Amazonian aquatic plant known as *Victoria regia* (royal water lily), which has large, tray-type leaves which float on the water and are able to withstand fairly high loads without becoming submerged.

Current structural floating roofs, on the other hand, because they are rigid structures, distribute the effects of an uneven load over the entire structural area, which can contribute to their turning over.

It is claimed:

1. A floating roof for tanks for storing liquid, comprising:

a peripheral ring formed by a first plurality of joined plates, each said joined plate having an upper face and a bottom face, said peripheral ring including a first plurality of floats, each said float of said first plurality of floats being mounted to the upper face of a said plate defining said peripheral ring;

a central platform formed by a second plurality of joined plates, each of said joined plates having an upper face and a bottom face, said central platform including a second plurality of floats, each said float of said second plurality of floats being mounted to the upper face of a said plate of said central platform, whereby a bottom face of the floating roof for being disposed in contact with liquid stored in the tank, defined by said bottom faces of said plates of said peripheral ring and said bottom faces of said plates of central platform, is substantially flat.

2. The floating roof of claim 1, wherein each of said floats has a cover, at least some of said covers being domed whereby a concentration of rain water is prevented.

3. The floating roof of claim 1, wherein said first plurality of floats are substantially symmetrically distributed about the peripheral ring.

4. The floating roof of claim 1, wherein said second plurality of floats are substantially symmetrically distributed over said central platform.

5. The floating roof of claim 1, wherein said plurality of joined plates of said central platform are disposed as rows of plates and wherein said second plurality of floats are mounted to alternating rows of said plates.

6. The floating roof of claim 1, wherein said floats of said first plurality of floats are disposed on alternate plates of said peripheral ring.

7. The floating roof of claim 1, wherein said central platform and peripheral ring are substantially free from regidifying structure resisting elastic deformation whereby said ring and platform can deform in response to an applied load.

8. A tank having liquid stored therein and having a floating roof floating on said liquid, said floating roof comprising:

a peripheral ring formed by a first plurality of joined plates, each said joined plate having an upper face and a bottom face, said peripheral ring including a first plurality of floats, each said float of said first plurality of floats being mounted to the upper face of a said plate of said peripheral ring;

a central platform formed by a second plurality of joined plates, each of said joined plates having an upper face and a bottom face, said central platform including a second plurality of floats, each said float of said second plurality of floats being mounted to the upper face of a said plate of said central platform, whereby a bottom face of the floating roof, defined by said bottom faces of said plates of said peripheral ring and said bottom faces of said plates of central platform and disposed in contact with said liquid, is substantially flat.

9. The tank of claim 8, wherein each of said floats has a cover, at least some of said covers being domed whereby a concentration of rain water is prevented.

10. The tank of claim 8, wherein said first plurality of floats are substantially symmetrically distributed about the peripheral ring.

11. The tank of claim 8, wherein said second plurality of floats are substantially symmetrically distributed over said central platform.

12. The tank of claim 8, wherein said plurality of joined plates of said central platform are disposed as rows of plates and wherein said second plurality of floats are mounted to alternating rows of said plates.

13. The tank of claim 8, wherein said floats of said first plurality of floats are disposed on alternate plates of said peripheral ring.

14. The tank of claim 8, wherein said central platform and peripheral ring are substantially free from rigidifying structure resisting elastic deformation whereby said ring and platform can deform in response to an applied load.

* * * * *

UNITED STATES PATENT AND TRADEMARK OFFICE

CERTIFICATE OF CORRECTION

PATENT NO. : 6,193,092 B1
DATED : February 27, 2001
INVENTOR(S) : Witter

It is certified that error appears in the above-identified patent and that said Letters Patent is hereby corrected as shown below:

Title page,
"[75] Inventor: Roger Vierira Witter, deceased, late of São Leopoldo (BR), by Mario Luiz Novaaes Avila, legal representative" should be
-- [75] Inventor: Aldyr Witter, deceased, late of São Leopoldo (BR), by Roger Vierira Witter, legal representative --

Signed and Sealed this

Eighteenth Day of December, 2001

*Attest:*

*Attesting Officer*

JAMES E. ROGAN
*Director of the United States Patent and Trademark Office*